US007540491B2

(12) United States Patent
Sherman et al.

(10) Patent No.: US 7,540,491 B2
(45) Date of Patent: Jun. 2, 2009

(54) AUTOMATIC, LOCKABLE, ENGAGEABLE AND DISENGAGEABLE MEDIA TRAY

(75) Inventors: Raymond C Sherman, Camas, WA (US); Luke Sosnowski, Camas, WA (US); Louis Barinaga, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 380 days.

(21) Appl. No.: 11/142,655

(22) Filed: Jun. 1, 2005

(65) Prior Publication Data

US 2006/0285447 A1 Dec. 21, 2006

(51) Int. Cl.
*B65H 1/08* (2006.01)

(52) U.S. Cl. ..... 271/127; 271/126; 74/149; 192/215

(58) Field of Classification Search ..... 271/126, 271/127, 147, 157, 155, 156; 74/435, 125.5, 74/149; 192/215, 126
See application file for complete search history.

(56) References Cited

U.S. PATENT DOCUMENTS

| | | | | | |
|---|---|---|---|---|---|
| 1,617,374 | A | * | 2/1927 | Christophel | 271/156 |
| 1,627,015 | A | * | 5/1927 | Davidson | 271/115 |
| 1,651,444 | A | * | 12/1927 | Christophel | 271/156 |
| 2,672,581 | A | * | 3/1954 | Gorham | 318/15 |
| 2,945,169 | A | * | 7/1960 | Carr | 318/674 |
| 3,096,673 | A | * | 7/1963 | Walker, et al. | 82/124 |
| 3,273,884 | A | * | 9/1966 | Zahradnik | 271/22 |
| 3,724,839 | A | * | 4/1973 | Suzuki | 271/117 |
| 4,196,898 | A | | 4/1980 | Kanai et al. | |
| 4,311,059 | A | * | 1/1982 | Wagle | 74/116 |
| 4,418,903 | A | * | 12/1983 | Landa | 271/10.04 |
| 4,522,382 | A | | 6/1985 | Chu et al. | |
| 4,878,799 | A | | 11/1989 | Seto | |
| 5,149,217 | A | | 9/1992 | Narita | |
| 5,228,676 | A | * | 7/1993 | Arai et al. | 271/117 |
| 5,391,009 | A | | 2/1995 | Stodder | |
| 5,501,444 | A | * | 3/1996 | Yukimachi et al. | 271/127 |
| 5,738,453 | A | * | 4/1998 | Tsuburaya et al. | 400/624 |
| 5,820,275 | A | | 10/1998 | Crawford et al. | |
| 5,895,038 | A | * | 4/1999 | Takashima | 271/114 |
| 5,954,326 | A | * | 9/1999 | Gaarder et al. | 271/9.02 |
| 5,992,993 | A | * | 11/1999 | Kiyohara et al. | 347/104 |
| 6,056,285 | A | * | 5/2000 | Kikuta et al. | 271/118 |
| 6,179,499 | B1 | | 1/2001 | Beretta et al. | |
| 6,257,569 | B1 | * | 7/2001 | Rhodes et al. | 271/117 |
| 6,406,201 | B1 | | 6/2002 | Beretta et al. | |
| 6,422,773 | B1 | * | 7/2002 | Lim | 400/710 |

(Continued)

FOREIGN PATENT DOCUMENTS

| | | |
|---|---|---|
| EP | 0106568 | 4/1984 |

(Continued)

OTHER PUBLICATIONS

International Search Report dated Dec. 8, 2006 for PCT/US2006/019216, Hewlett-Packard (4 pages).

*Primary Examiner*—Patrick H Mackey
*Assistant Examiner*—Gerald W McClain

(57) ABSTRACT

A media handling system, comprising: a media pick means; a media holder that interacts with the media pick means; and a selectable, lockable, automatically movable media tray located substantially adjacent to the media holder, wherein the movable media tray is engageable/disengageable with the media pick means.

19 Claims, 3 Drawing Sheets

U.S. PATENT DOCUMENTS

| | | | | |
|---|---|---|---|---|
| 6,945,721 | B2 * | 9/2005 | Sato | 400/708 |
| 6,991,392 | B2 * | 1/2006 | Hult et al. | 400/624 |
| 6,994,341 | B2 * | 2/2006 | Aoki et al. | 271/117 |
| 7,165,765 | B2 * | 1/2007 | Sonoda et al. | 271/122 |
| 7,222,847 | B2 * | 5/2007 | Yamamoto | 271/153 |
| 2003/0025263 | A1 | 2/2003 | Koga | |
| 2003/0201597 | A1 * | 10/2003 | Koh | 271/147 |
| 2005/0024663 | A1 | 2/2005 | Matsuoka | |
| 2005/0218584 | A1 * | 10/2005 | Dan | 271/127 |
| 2005/0258586 | A1 * | 11/2005 | Elenes et al. | 271/9.01 |

FOREIGN PATENT DOCUMENTS

| | | | |
|---|---|---|---|
| EP | 1598202 | | 11/2005 |
| JP | 62255330 | | 11/1987 |
| JP | 63176227 | A * | 7/1988 |
| JP | 01133826 | A * | 5/1989 |

* cited by examiner

AUTOMATIC, LOCKABLE, ENGAGEABLE AND DISENGAGEABLE MEDIA TRAY

BACKGROUND OF THE INVENTION

1. Field of the Invention

This invention relates to a media handling system, comprising: a media pick means; a media holder that interacts with the media pick means; and a selectable, lockable, automatically movable media tray located substantially adjacent to the media holder, wherein the movable media tray is engageable/disengageable with the media pick means.

2. Description of the Related Art

Prior to the present invention, as set forth in general terms above and more specifically below, it is known, in prior media tray systems, that if the user fails to properly engage the media tray, media may be pulled from the main media tray and the print may be made on media that it is probably not intended for. Consequently, this wasted media and ink/toner and frustrated the user because the media they desired was not used. Conversely, if the media tray was not disengaged after printing a specialized media, the next print job may pull that expensive media from the media tray and use it, thereby wasting ink/toner and media. Consequently, a more advantageous system, then, would be provided if such user frustration and ink/toner and media waste could be avoided.

It is also known, in the media handling art, to employ a variety of media tray designs that can be used in conjunction with a variety of media pick system designs. For example, it is known to employ to separate media trays that interact with different media pick systems. It is also known to employ separate media trays that share one media pick system. It is further known to employ two media pick systems that share a split gear train. It is even further known to employ multiple media trays that share a split gear system. Finally, it is still further known to use movable media trays. While these systems have met with a modicum of success, none of these systems uses a single pick system to automatically move the desired media, such as photographic media, into and out of the pick system.

It is apparent from the above that there exists a need in the art for a media handling system that decreases user frustration and ink/toner waste, while at the same time uses a single pick system to automatically move the desired media, such as photographic media, into and out of the pick system. Also, it is desirous to employ a system that allows a variety of media to be loaded at the same time. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing a media handling system, comprising: a media pick means; a media holder that interacts with the media pick means; and a selectable, lockable, automatically movable media tray located substantially adjacent to the media holder, wherein the movable media tray is engageable/disengageable with the media pick means.

In certain preferred embodiments, the media pick means is used to pick media from the media holder and the movable media tray. Also, the media holder can be, but is not limited to, a media tray. Finally, the media handling system utilizes a media tray lock and a tray lock spring in order to engage/disengage the movable media tray with/from the media pick means.

In another further preferred embodiment, a media handling system is presented that decreases user frustration and ink/toner waste, while at the same time uses a single pick system to automatically move that desired media, such as photographic media, into and out of the pick system. Also, this system allows a variety of media to be loaded at the same time.

The preferred media handling system, according to various embodiments of the present invention, offers the following advantages: ease-of-use; reduced part count; automated movement of the media tray; reduced ergonomic issues; increased user satisfaction; and reduction in consumable waste. In fact, in many of the preferred embodiments, these factors of ease-of-use, automated movement of the media tray, reduced ergonomic issues, increased user satisfaction, and reduction in consumable waste are optimized to an extent that is considerably higher than heretofore achieved in prior, known media handling systems.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
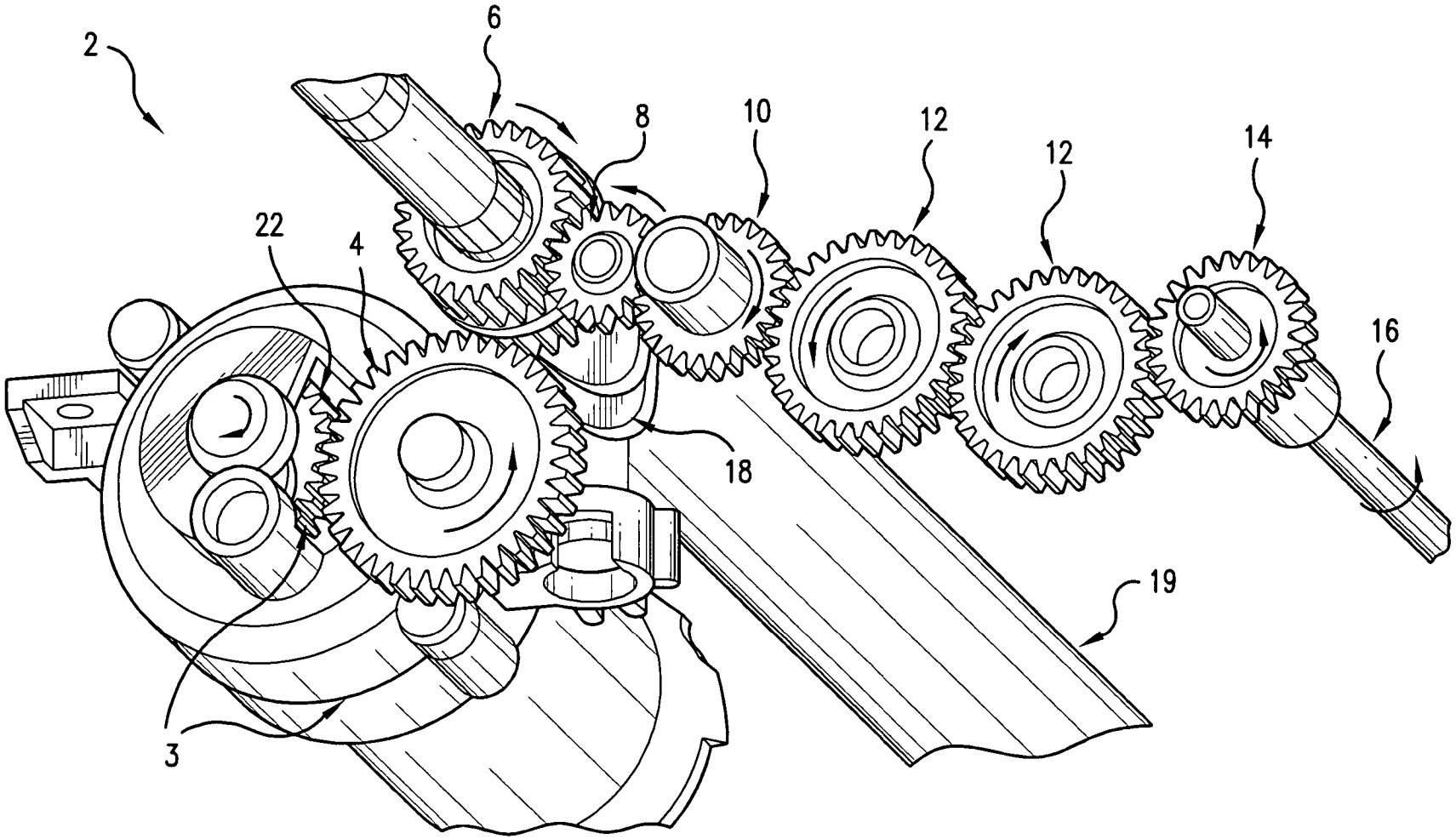
FIG. 1 is a schematic illustration of a pick train or transmission, according to one embodiment of the present invention.

With reference first to FIG. 1, there is illustrated one preferred embodiment for use of the concepts of this invention. Pick transmission 2 is shown in FIG. 1. As can be seen, power is transferred from the pick motor 3 to rotate pick arm 16. Pick transmission 2 includes, in part, pick motor 3, transfer gear 4, drive gear 6, idler gear 8, platen drive gear 10, platen gears 12, pick shaft drive gear 14, pick arm 16, center bearing 18, feed roller 19, and pick motor gear 22. The main function of the pick transmission or train 2 is to deliver torque from the pick motor 3 to the pick arm 16 to pick a sheet of media from the media input storage holder (not shown) or media tray 46 (FIG. 3) and move those sheets of media into the feed roller 19.

Figure 2:
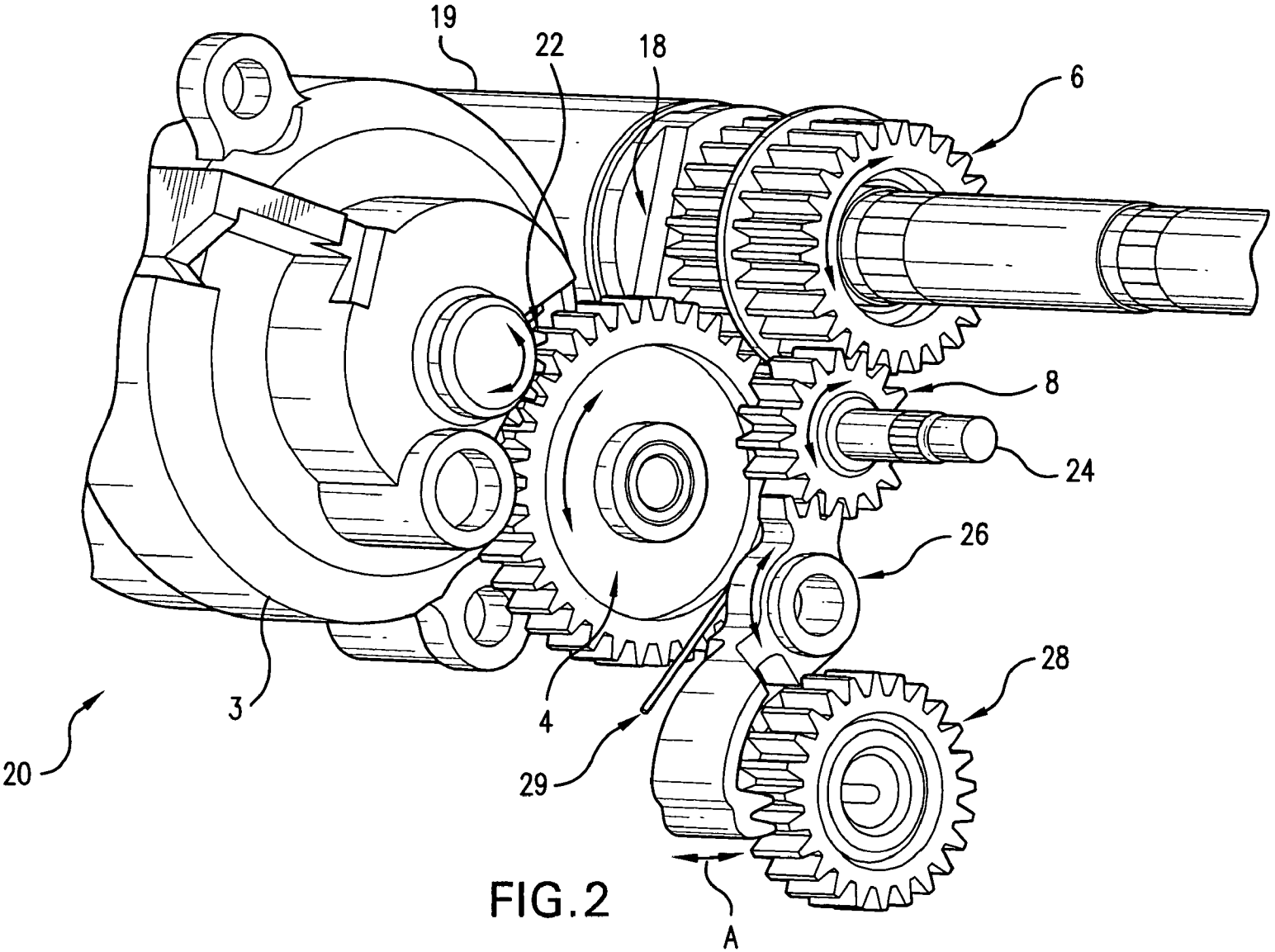
FIG. 2 is a schematic illustration of a media tray lock train or transmission, according to another embodiment of the present invention.

During the operation of pick transmission 2, power is transferred from pick motor 3 to pick motor gear 22 which interfaces with transfer gear 4. Transfer gear 4 interfaces with drive gear 6 which is the primary gear that engages pick motor 3. Drive gear 6 then meshes with an idler gear 8. Idler gear 8 spins freely on a swing arm pin 24 (FIG. 2). Because idler gear 8 moves with the swing arm (not shown), it moves into different positions around drive gear 6 and distributes power to various trains. Drive gear 6 spins freely on center bearing 18. Because drive gear 6 is not coupled to the shaft of feed roller 19, it is independent of the feed roller shaft and is isolated by center bearing 18. It is to be understood that platen drive gear 10 and platen gears 12 stand on posts (not shown) on the platen (not shown). Also, pick shaft drive gear 14 is rigidly attached to the pick arm 16 and spins in a bearing surface (not shown) in the platen. The platen is typically used to assist in feeding the media and assist in placing the marks upon the media by the printing device.

During the operation of media tray lock transmission 20 (FIG. 2), transmission 20 locks and unlocks the gear train that drives the automatic media tray 46 (FIG. 3) in and out of the mechanism. Transmission 20 delivers torque from pick motor 3 to engage/disengage media tray lock 26. Transmission 20 includes, in part, pick motor gear 22, swing arm pin 24, media tray lock 26, media idler gear 28, and tray lock spring 29. As can be seen in FIG. 2, transfer gear 4 takes power from pick motor 3 and pick motor gear 22 and transfers that power to drive gear 6 which spins freely on center bearing 18. Drive gear 6 engages idler gear 8 and spins freely on the swing arm pin 24. Because idler gear 8 moves with the swing arm, idler gear 8 can move into different positions around drive gear 6 and distribute power to various trains.

In this particular gear train, idler gear 8 engages with a plurality of teeth on media tray lock 26 which rotates about a pin (not shown) on the platen. As idler gear 8 rotates in either direction, it swings media tray lock 26 through an arc (A). It is to be understood that the movement of media tray lock 26 can be limited by a hard stop (not shown) on the platen. As media tray lock 26 swings through its arc (A), several teeth on media tray lock 26 engage or disengage with media idler gear 28. It is to be understood that when the teeth of media tray lock 26 are engaged with teeth in media idler gear 28, media idler gear 28 stops spinning and media tray drive transmission 30 (FIG. 3) cannot operate until media tray lock 26 is unlocked. In order to unlock transmission 20, media tray lock 26 is moved in its arc (A) to disengage its teeth from media idler gear 28, thereby allowing media tray drive transmission 30 to move.

It is to be understood that media tray lock 26 is spring-loaded with media tray lock spring 29 such that media tray lock 26 is engaged with media idler gear 28. Media tray lock spring 29, preferably, is a torsion spring that pushes against the platen as a reference and pushes against media tray lock 26. In this manner, media tray lock 26 is engaged in its free state and transmission 20 is locked. In order to unlock transmission 20, media tray lock 26 must be actively unlocked and held unlocked by pick motor 3. It is to be understood that when media tray lock 26 is engaged, lock 26 prevents tray 46 (FIG. 3) from moving inward, but allows the user to pull tray 46 into the "out" position in case of a fault (media jam, etc.). This should allow the user to more easily clear media jams.

Figure 3:
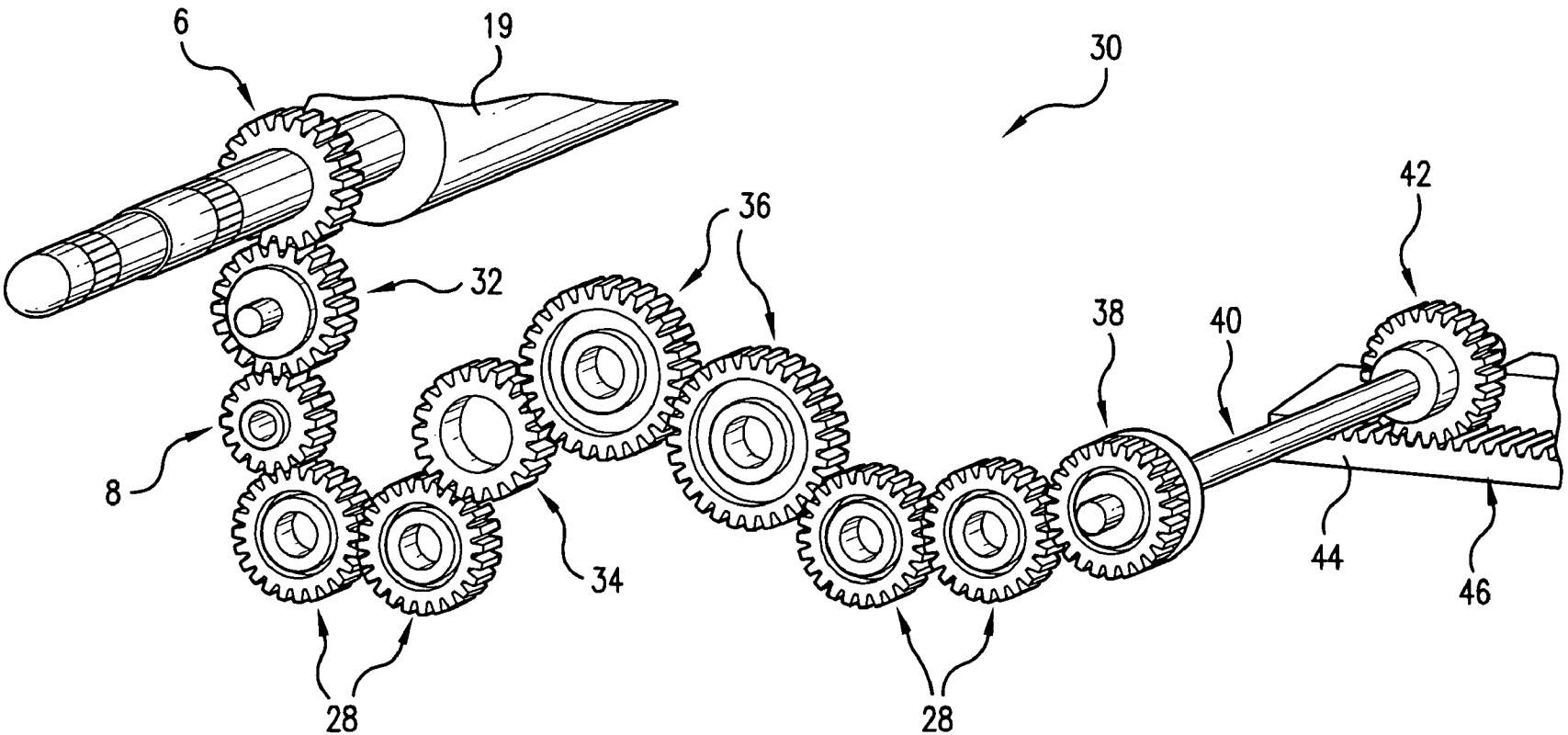
FIG. 3 is a schematic illustration a media tray drive train or transmission, according to the embodiment of the present invention.

With respect to FIG. 3, media tray drive transmission 30 includes, in part, drive idler gear 32, media gear 34, platen gears 36, media gear 38, media tray drive shaft 40, media tray gear 42, rack 44, and media tray 46. As can be seen in FIG. 3, with the media tray lock transmission 20 unlocked, media tray drive transmission 30 transfers torque from a paper motor (not shown) to turn the shaft of feed roller 19. Power is diverted from the shaft of feed roller 19 through the gear train to drive media tray 46 in and out of the mechanism. In this manner, media tray 46 is moved out (the idle position) to present it to the user for loading media. Media tray 46 is then moved in to position the media at the pick arm 16 and feed roller 19 (FIG. 1) for media picking.

During the operation of transmission 30, drive gear 6 is attached to the shaft of feed roller 19. Drive gear 6 is driven by the paper motor. As the shaft of feed roller 19 rotates, drive gear 6 turns with the shaft of feed roller 19 and engages drive idler gear 32 which spins on a pin (not shown) on the swing arm. Drive idler gear 32 engages platen idler gear 8 which spins on a post (not shown) on the platen. Platen idler gear 8 engages one of two media idler gears 28 that spin on pins (not shown). The second media idler gear 28 engages with media gear 34 that spins on a valve shaft (not shown). Media gear 34 engages one of two platen gears 36 which spin on posts (not shown) on the platen. The second platen gear 36 engages two or more media idler gears 28 that spin on platen posts (not shown) and engage media gear 38. Media gear 38 is rigidly attached to media tray drive shaft 40 which turns media tray gear 42. Media tray gear 42 interacts with rack 44 on media tray 46 to move media tray 46 linearly in and out of the mechanism so that the user can load the media, such as photographic media, into media tray 46 and also allow media to be loaded into the media input storage holder (not shown) at the same time. Media tray 46 is then moved in to position the media at the pick arm 16 and feed roller 19 (FIG. 1) for media picking.

Also, the present invention can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In preferred embodiments, the present invention can be implemented in a combination of software and data executed and stored under the control of a computing device.

It will be well understood by one having ordinary skill in the art, after having become familiar with the teachings of the present invention, that software applications may be written in a number of programming languages now known or later developed.

Once given the above disclosure, many other features, modifications or improvements will become apparent to the skilled artisan. Such features, modification or improvements are, therefore, considered to be a part of this invention, the scope of which is to be determined by the following claims.

What is claimed is:

1. A media handling system, comprising:

a media pick assembly including a pick motor and an idler gear driven by the pick motor;

a movable media tray selectively operated by the pick motor of the media pick assembly via a media idler gear mounted on a pin for rotation about an axis of the pin; and a media tray lock having a first end engaged in direct physical contact with the idler gear of the media pick assembly and a second end selectively engaged in direct physical contact and disengaged from direct physical contact with the media idler gear, wherein the media tray lock locks the media tray from operation by the pick motor when the second end of the media tray lock is engaged in direct physical contact with the media idler gear.

2. The media handling system, as in claim 1, wherein the media pick assembly is further comprised of:

a pick arm configured to pick a sheet of media from the media tray; and a media pick drive train configured to transfer power from the pick motor to the pick arm.

3. The media handling system, as in claim 2, wherein the media pick drive train is further comprised of:

a transfer gear operatively connected to the pick motor;

a first drive gear engaged with the transfer gear;

the idler gear of the pick assembly engaged with the first drive gear;

a second drive gear engaged with the idler gear;

one of a plurality of first platen gears engaged with the second drive gear; and a pick shaft drive gear engaged with another of the plurality of first platen gears, wherein the pick arm is operably connected to the pick shaft drive gear.

4. The media handling system, as in claim 3, wherein the media pick assembly is further comprised of:

a center bearing rotatably connected to the first drive gear; and a feed roller operatively connected to the first drive gear.

5. The media handling system, as in claim 3, wherein the media pick assembly is further comprised of:

a pick motor gear operatively connected to the pick motor and engaged with the transfer gear.

6. The media handling system, as in claim 3, further comprising:

a media tray drive train configured to transfer power from the pick motor to the media tray.

7. The media handling system, as in claim 6, wherein the media tray drive train is further comprised of:

the transfer gear operatively connected to the pick motor;

the first drive gear engaged with the transfer gear;

the idler gear of the pick assembly engaged with the first drive gear; and the media idler gear selectively engaged by the second end of the media tray lock.

8. The media handling system, as in claim 7, wherein the media tray lock substantially prevents the media tray from moving inward, but allows the media tray to be pulled out.

9. The media handling system, as in claim 7, wherein the media tray drive train is further comprised of:

a drive idler gear engaged with the first drive gear and a platen idler gear;

a plurality of first media idler gears engaged with the platen idler gear and a first media gear;

a plurality of second platen gears engaged with the first media gear and one of a plurality of second media idler gears;

a second media gear engaged with another of the plurality of second media idler gears;

a media tray drive shaft rigidly connected to the second media gear;

a media tray gear rigidly connected to the media tray drive shaft; and a rack connected to the media tray, wherein the rack interacts with the media tray gear to move the media tray.

10. The media handling system, as in claim 1, wherein the media idler gear is stopped from spinning when the second end of the media tray lock engages the media idler gear.

11. The media handling system, as in claim 1, wherein the media tray lock substantially prevents the media tray from moving in a first direction, but allows the media tray to be moved in a second direction opposite the first direction.

12. The media handling system, as in claim 1, wherein the second end of the media tray lock swings through an arc and engages the media idler gear as the idler gear of the media pick assembly rotates.

13. The media handling system, as in claim 1, wherein the media tray lock includes a first set of teeth at the first end and a second set of teeth at the second end, wherein the first set of teeth engage the idler gear of the media pick assembly and the second set of teeth selectively engage the media idler gear.

14. The media handling system, as in claim 1, further comprising:

a tray lock spring configured to bias the second end of the media tray lock into engagement with the media idler gear.

15. The media handling system, as in claim 1, wherein the media pick assembly is further comprised of:

a transfer gear operatively connected to the pick motor; and a first drive gear engaged with the transfer gear, wherein the idler gear of the media pick assembly is engaged with the first drive gear.

16. The media handling system, as in claim 15, wherein the media pick assembly is further comprised of:

a center bearing rotatably connected to the first drive gear; and a feed roller operatively connected to the first drive gear.

17. The media handling system, as in claim 15, wherein the media pick assembly is further comprised of:

a pick motor gear operatively connected to the pick motor and engaged with the transfer gear.

18. The media handling system, as in claim 1, wherein the media idler gear comprises a spur gear.

19. The media handling system, as in claim 1, wherein the media idler gear is configured to transfer power to a rack associated with the media tray.

* * * * *

UNITED STATES PATENT AND TRADEMARK OFFICE

CERTIFICATE OF CORRECTION

PATENT NO. : 7,540,491 B2
APPLICATION NO. : 11/142655
DATED : June 2, 2009
INVENTOR(S) : Raymond C Sherman et al.

It is certified that error appears in the above-identified patent and that said Letters Patent is hereby corrected as shown below:

On the Title page, in field (54), in "Title", in column 1, lines 1-2, delete "AUTOMATIC, LOCKABLE, ENGAGEABLE AND DISENGAGEABLE MEDIA TRAY" and insert -- AUTOMATIC, LOCKABLE AND ENGAGEABLE/DISENGAGEABLE MEDIA TRAY --, therefor.

In column 1, lines 1-2, delete "AUTOMATIC, LOCKABLE, ENGAGEABLE AND DISENGAGEABLE MEDIA TRAY" and insert -- AUTOMATIC, LOCKABLE AND ENGAGEABLE/DISENGAGEABLE MEDIA TRAY --, therefor.

Signed and Sealed this

Sixth Day of April, 2010

David J. Kappos

David J. Kappos
*Director of the United States Patent and Trademark Office*